United States Patent [19]

Castelli et al.

[11] Patent Number: 4,782,673

[45] Date of Patent: Nov. 8, 1988

[54] CONNECTION DEVICE

[75] Inventors: Rene Castelli, Ghent; Willibald van Hoye, Zwijnaarde, both of Belgium; Ulf G. Rasch, Nachrodt-Einsal; Klaus-Dieter Hesse, Sundern, both of Fed. Rep. of Germany; Richard Miles, Crowborough, Great Britain

[73] Assignee: Samsonite Corporation, Denver, Colo.

[21] Appl. No.: 60,109

[22] Filed: Jun. 9, 1987

Related U.S. Application Data

[63] Continuation of Ser. No. 772,341, Aug. 20, 1985, abandoned.

[30] Foreign Application Priority Data

Dec. 23, 1983 [DE] Fed. Rep. of Germany ... 8337033[U]
Jan. 25, 1984 [DE] Fed. Rep. of Germany ..... 3402430

[51] Int. Cl.[4] ..... E05B 65/48

[52] U.S. Cl. ..... 70/72; 70/75; 70/76; 70/312; 292/113

[58] Field of Search ..... 70/7, 72, 73–76, 70/312; 292/113, 114

[56] References Cited

U.S. PATENT DOCUMENTS

| | | | |
|---|---|---|---|
| 2,800,346 | 7/1957 | Manning | 292/113 |
| 2,912,844 | 11/1959 | Atkinson | 70/75 |
| 2,921,810 | 1/1960 | Smith | 292/113 |
| 3,008,320 | 11/1961 | Cheney | 292/113 |
| 3,237,434 | 3/1966 | Jackes et al. | 70/305 X |
| 3,259,411 | 7/1966 | Griffiths | 292/113 |
| 3,394,955 | 7/1968 | Martin | 292/113 |
| 3,434,314 | 3/1969 | Atkinson | 70/76 |
| 3,482,421 | 12/1969 | Franzen | 70/74 |
| 3,490,805 | 1/1970 | Di Pierro | 292/113 |
| 3,545,238 | 12/1970 | Gehrie et al. | 70/76 |
| 3,584,906 | 6/1971 | Budzyn | 70/76 |
| 3,602,723 | 8/1971 | Swanson | 292/113 |
| 3,936,082 | 2/1976 | Swanson | 292/113 |
| 4,049,301 | 9/1977 | Schenk | 292/113 |
| 4,243,255 | 1/1981 | Hornak | 292/113 |

FOREIGN PATENT DOCUMENTS

| | | | |
|---|---|---|---|
| 715282 | 8/1965 | Canada | 70/75 |

*Primary Examiner*—Robert L. Wolfe
*Assistant Examiner*—Suzanne L. Dino
*Attorney, Agent, or Firm*—John R. Ley

[57] ABSTRACT

A connection device for releasably interconnecting two members (16, 18) preferably a receptacle and its lid, comprising an upper component (1, 101) which is provided with a hook (21, 102) and a lower component (2, 103) and a one- or two-armed lever (3, 104) which is articulated on said lower component and which is provided with a counterhook (15, 105). In order to avoid that the connection device springs open or disengages unintentionally, a snapper (5, 109) is pivotably attached to the end of the lever (3, 104) facing away from the counterhook (15, 105), said snapper being provided with a locking projection (13, 113) which is associated with a complementary, projecting locking member (14, 114) of the lower component (2, 103) and which is equipped with a spring (12, 115) holding the snapper (5, 109) in its locking position.

6 Claims, 4 Drawing Sheets

CONNECTION DEVICE

Figure 1:
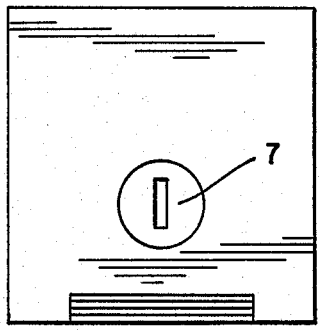

This application is a continuation of application Ser. No. 772,341, filed Aug. 20, 1985 now abandoned.

The present invention refers to a connection device for releasably interconnecting two members, preferably a receptacle and its lid, comprising an upper component which has to be attached to said one member (lid) and which is provided with a hook, a lower component which has to be attached to the other member (receptacle), and a one- or two-armed lever which is articulated on said lower component either directly or via at least one link and which is provided with a counterhook associated with the hook of the upper component.

In the case of such toggle-lever locks with one-piece or two-piece levers there is the risk that said locks spring open automatically in response to movements between the members to be connected, or that they disengage unintentionally when bumping against other objects or when they get caught by articles of clothing etc. In the case of one-piece levers a hinge member is required for connecting the lever to the lower component, said hinge member being normally fastened to the lever and to the lower component by means of one rivet for each fastening connection, and this involves a comparatively great expenditure.

On the basis of this prior art, the task underlying the invention is to provide—while avoiding the above-mentioned disadvantages—a connection device of the type referred to at the beginning, which cannot only be produced and mounted in a simple manner, but which, in addition, also reliably guarantees that unintentional springing open in the non-locked condition of the connection device is prevented.

In accordance with the invention, this is achieved by means of the features that a snapper is pivotably attached to the side of the lever facing away from the counterhook, said snapper being provided with a locking projection which is associated with a complementary, projecting locking member of the lower component and which is equipped with a spring holding the snapper in its locking position. By means of the snapper it is achieved that, when the lever is in its closing position, it cannot be released unintentionally because it is secured in position on the lower component by means of the snapper. The locking position of the lever can only be eliminated by means of intentional actuation of the snapper, for which purpose the force of a spring has to be overcome, so that it is then possible to open said lever.

The locking member of the lower component can be formed in a simple manner by an angled portion on a front edge of said lower component. One or several spring lobes formed on the snapper can be used as the spring of the snapper so that, on the whole, a simple structural component is obtained. It will be advantageous when the lever is pivotably supported by means of two U-shaped metal wire bows which are inserted into support means provided within the lever and the base plate, said metal wire bows being laterally inserted into said lever and into said base plate. The end face of the lower component facing the upper component may have formed thereon a support means with a substantially cylindrical recess, whereas the lever end facing away from the upper component may have provided thereon two spaced little bearing blocks. The legs of the U-shaped wire bows can be in engagement with these bearing means so that a very simple structural design and an assembly operation which is just as simple are obtained.

It will be of advantage when the little bearing blocks of the lever have inserted between them the snapper which is provided with a substantially cylindrical support member, said support member being in engagement with the legs on one side of the U-shaped metal wire bows so that the snapper is pivotably supported together with the lever, but adapted to be pivoted independently of said lever.

It will be advantageous when the legs of at least one of said U-shaped metal wire bows have attached thereto a double helical spring, said spring being attached by means of the respective loops formed by the helical springs. One end of said double helical spring rests on the lower component, whereas the other end rests on the lever. Due to the double helical spring, the lever is caused to assume a specific, preferably horizontal position. This predetermined open position of the lever is determined by stop means provided on the lower component and on the lever and associated with the U-shaped bows. The U-shaped metal wire bows are held on the lower component by means of flaps extending at an angle to said lower component. Hence, the mounting of said metal wire bows only requires the measure of inserting said metal wire bows and bending the angled flaps by 90°.

It will be of advantage when one embodiment of the connection device according to the invention is designed such that the lever has provided therein a catch means whose bolt is associated with an angular member of the lower component so that, when the bolt is operated by means of a key, said bolt engages behind the angular member of the lower component, which has the effect that the connection device is locked.

An alternative, advantageous embodiment of the connection device according to the invention is based on the features that the snapper is provided with at least one cam, each of said cams having associated therewith a locking disc, which, in the peripheral surface thereof, includes a recess adapted to the cam, each of said locking discs being non-positively connected to an adjustment disc, and that each unit consisting of a locking disc and of an adjustment disc is rotatably supported on the inner side of the lever. On the basis of this structural design, the connection device is provided with a permutation lock by means of which the snapper is locked or released so that the snapper is secured against unauthorized actuation, which has the effect that the whole connection device is secured against unauthorized opening. In the case of this very reasonably-priced embodiment, it is necessary to set the correct opening code whenever the locking mechanism is closed.

A modified, alternative structural design of the above-described embodiment of the connection device according to the invention—in the case of which the measure of setting the correct opening code of the permutation lock when closing the connection device can be dispensed with—is based on the features that the snapper is coupled with an actuating lever which is adapted to be moved relative to said snapper and to be brought into a positive drive-type engagement therewith in the direction in which the opening movement is carried out, said actuating lever being provided with at least one cam and each of said cams having associated therewith a locking disc, which, in the peripheral surface thereof, includes a recess adapted to the cam and which is connected to an adjustment disc by means of a non-positive connection, and that each unit consisting of a locking disc and of an adjustment disc is rotatably supported on the inner side of the lever.

It will be of advantage when the actuating lever is provided with a projection which has associated therewith a shoulder of the snapper. When the actuating lever is operated so as to move to its open position, the projection of said actuating lever acts on the shoulder of the snapper and entrains the same so that the locking projection of said snapper releases the locking member of the lower component, which has the effect that the lever can be opened.

In order to guarantee the highest possible degree of safety, it is advisable to change—when the connection device has been opened—the set opening code by means of rotating the adjustment discs so that said opening code is concealed from other persons' sight. In order to permit closing of the lever in this changed position of the adjustment discs, the locking projection of the snapper has provided thereon an inclined conducting surface. When the lever is being closed, the inclined conducting surface of the locking projection comes into contact with the locking member of the lower component, is thus moved to its open position and re-engages behind the locking member of the lower component due to the action of its spring when the closing movement is being completed.

The snapper can be outwardly covered by a projecting wall of the actuating lever so that, when the actuating lever is in its blocked condition, the snapper is not accessible from the outside.

It will be advantageous when the snapper and the actuating lever are pivotably supported on a common axis in the lever, said snapper and said actuating lever being, however, adapted to be pivoted independently of one another. The lever is pivotably supported by means of two U-shaped metal wire bows which are inserted into support means provided within the lever and within the lower component, said metal wire bows being laterally inserted into said lever and into said lower component and the end face of the lower component facing the upper component having formed thereon a substantially cylindrical support means, whereas the end of the lever facing away from the upper component has provided thereon two spaced little bearing blocks and said spaced little bearing blocks of the lever having inserted between them the snapper, the actuating lever with a substantially cylindrical support member being inserted between the support eyes of the snapper and the legs on one side of the U-shaped metal wire bows engaging the little bearing blocks of the lever, the support eyes of the snapper and the cylindrical support member of the actuating lever. On the basis of this embodiment a simple structural design as well as a rapid assembling operation are obtained, the snapper and the actuating lever being provided on one axis, but being still independent of each other as far as their pivotal movements are concerned, it being only possible to couple said snapper and said actuating lever by means of a co-operation between the projection of the actuating lever and the shoulder of the snapper.

The legs of at least one of said U-shaped metal wire bows can have attached thereto a double helical spring, said spring being attached by means of the respective loops formed by the helical springs. One end of said double helical spring rests on the lower component, whereas the other end rests on the lever. Due to the double helical spring, the lever is caused to assume a specific, preferably horizontal position. This predetermined open position of the lever is determined by stop means provided on the lower component and on the lever and associated with the U-shaped metal wire bows. The U-shaped metal wire bows are held on the lower component by means of flaps extending at an angle to said lower component. The mounting of said metal wire bows only requires the measure of inserting said metal wire bows and bending the angled flaps by 90°.

The lever can be provided with approximately triangular side pieces in the area in which it is pivotably supported, said side pieces covering the snapper and the actuating lever so that said components are secured against access from the sides of the lever.

The inner side of the lever can have secured thereto a carrier member which is provided with bent edges having formed therein support eyes through which the legs on one side of the U-shaped metal wire bows extend and which, consequently, are incorporated in the support means of the lever of the snapper as well as of the actuating lever. The carrier member is provided with laterally projecting shoulders which are inserted into upwardly open grooves in the side pieces of the lever so that a simple and rapid assembling operation is obtained.

An advantageous embodiment is based on the feature that, in the closed position of the connection device, the projection of the actuating lever abuts with its upper surface on the lower surface of the carrier member. A limitation in the direction of the closed position of rest is thus provided.

The lever can have provided therein one or a plurality of viewing window(s), said viewing window(s) displaying numbers, symbols, letters or the like which are provided on the adjustment disc(s). The locking discs and the associated adjustment discs can be non-positively coupled by means of a spring resting on the locking disc on the one hand and on the carrier member on the other. The locking disc can be provided with recessed detent portions, detent cams of the associated adjustment disc engaging said recessed detent portions; these detent cams are used for the purpose of setting the opening code.

On the inner side of the lever detent knobs can be provided, said detent knobs having associated therewith detent depressions of the adjustment disc(s), so that noticeable snap-in positions can be perceived when the adjustment wheels are rotated.

Figure 2:
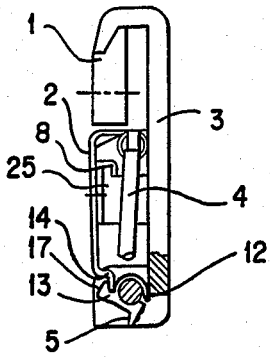
Figure 3:
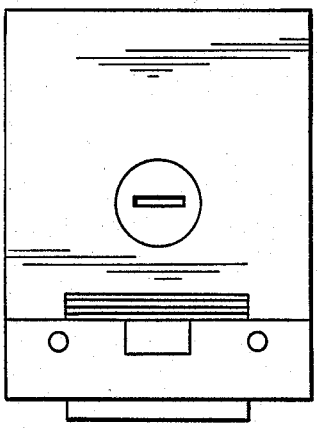
Figure 4:
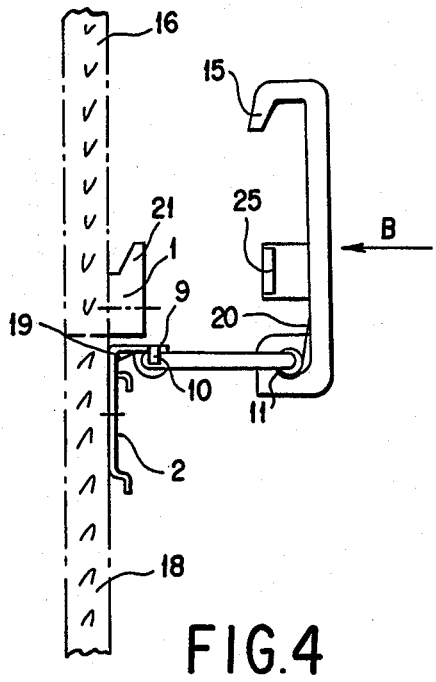
Figure 5:
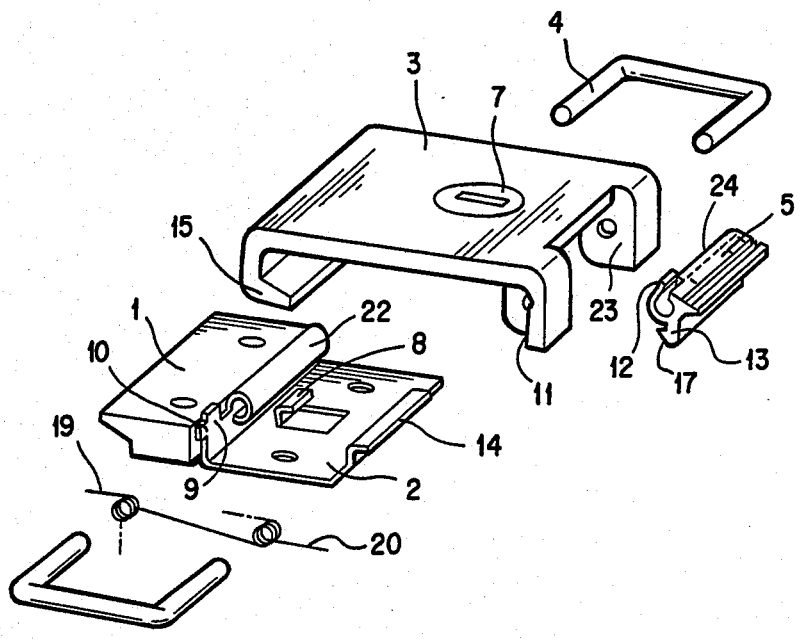
Figure 6:
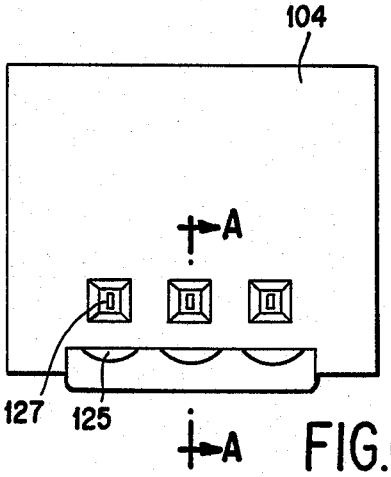
Figure 7:
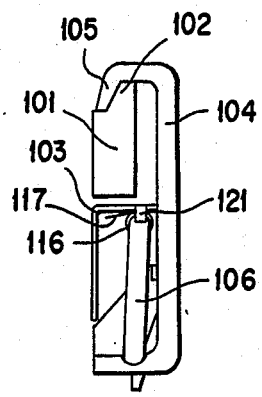
Figure 9:
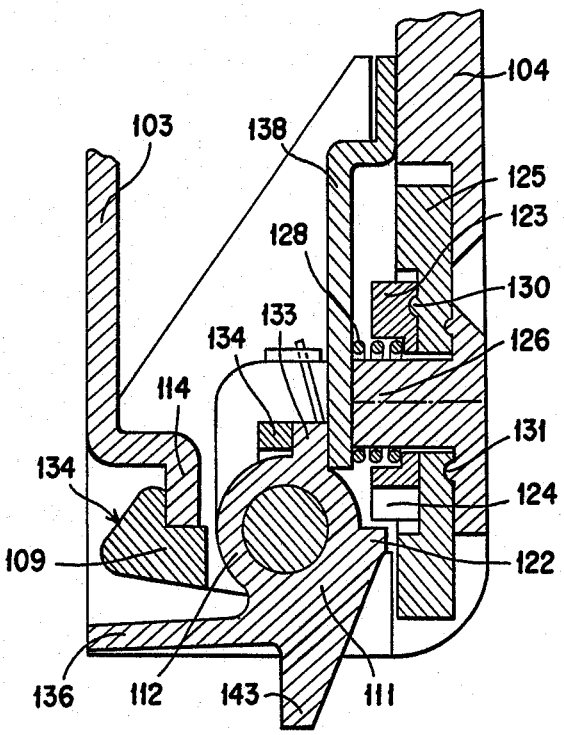
Figure 8:
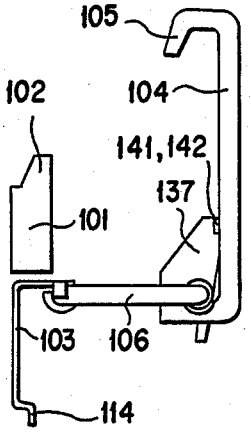
Figure 10:
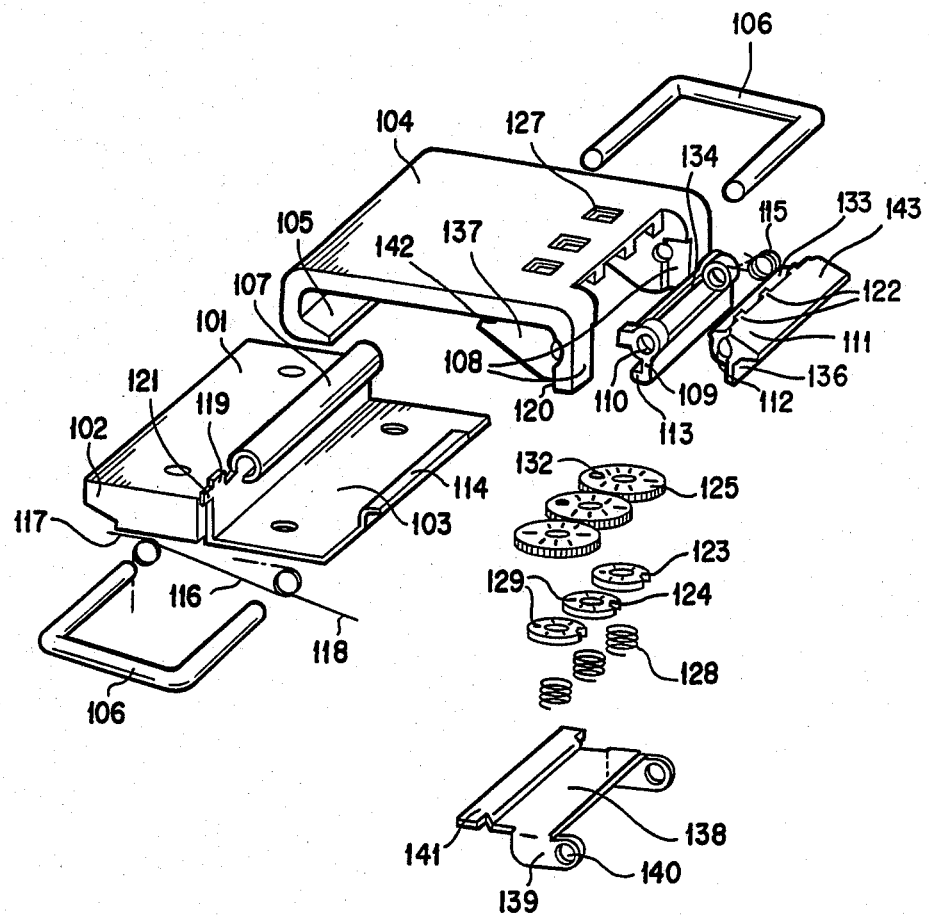

In the following, embodiments of the invention will be explained with reference to the drawing, in which:

FIG. 1 shows a representation of a closed and locked connection device in accordance with a first embodiment of the invention in the form of a toggle-lever lock, FIG. 2 shows a side view—part of which is a sectional view—of the connection device according to FIG. 1, FIG. 3 shows a representation of the open and unlocked toggle-lever lock according to FIGS. 1 and 2, FIG. 4 shows a side view of the connection device in its open position according to FIG. 3, FIG. 5 shows a perspective view of the structural components of the toggle-lever lock, FIG. 6 shows a representation of a closed connection device in accordance with a second embodiment of the invention in the form of a toggle-lever lock, FIG. 7 shows a side view of the connection device according to FIG. 6, FIG. 8 shows a side view of the open toggle-lever lock according to FIGS. 6 and 7, FIG. 9 shows a sectional side view in accordance with the line A—A of FIG. 6 and FIG. 10 shows a perspective view of the structural components of the toggle-lever lock according to FIGS. 6 to 9.

The connection device according to the first embodiment shown in FIGS. 1 to 5 compromises the upper component 1, which is provided with a hook 21, and of the lower component 2. The lower component 2 has pivotably provided thereon the lever 3, which, in the embodiment shown, is designed as a one-armed lever. The lever 3 is equipped with a counterhook 15 associated with the hook 21 of the upper component 1.

The lever 3 is pivotably supported on the lower component 2 by means of the two U-shaped metal wire bows 4. For this purpose, the end face of the lower component 2 facing the upper component 1 has formed thereon a substantially cylindrical support means 22. Moreover, two spaced little bearing blocks 23 are provided on the end of the lever 3 facing away from the upper component 1. The two little bearing blocks of the lever 3 have inserted between them the snapper 5. The snapper 5 is provided with a substantially cylindrical support member 24 which is in engagement with the legs on one side of the U-shaped metal wire bows 4 so that the pivotal support of the lever 3 is also effective for the snapper 5, said snapper being, however, adapted to be pivoted independently of the lever 3.

The snapper 5 is provided with a locking projection 13 which is associated with a complementary, projecting locking member 14 of lower component 2. The locking member 14 is formed by an angled portion on a front edge of the lower component 2. The snapper 5 is equipped with a spring 12 whose force is directed such that said spring holds the snapper 5 in its locking position.

The legs of one of the U-shaped metal wire bows 4 have attached thereto a double helical spring 6, said spring being attached by means of its helical spring members. One end 19 of the double helical spring 6 rests on the lower component 2, whereas the other end 20 rests on the lever 3. The double helical spring 6 causes the lever 3 to move to a predetermined open position, e.g. to a horizontal position, like that shown in FIG. 4. The lever is maintained in this position by stop means 9, 11 which are provided on the lower component 2 and on the lever 3, respectively.

The U-shaped metal wire bows 4 are held on the lower component 2 by means of flaps 10 extending at an angle to said lower component.

The lever 3 has provided therein a catch means 7 whose bolt 25 engages behind the angular member 8 of the lower component 2 in the locked condition.

The members to be interconnected are schematically represented in FIG. 4 and are provided with reference numerals 16, 18. The member 16 can be the lid of the receptacle 18.

The mode of operation of the device according to the invention is as follows:

For the purpose of opening the lever 3, the snapper 5 is gripped with the finger in the area of its locking projection 13—the catch means 7 being not locked—and is pivoted about its pivotal axis so that the locking projection 13 releases the locking member 14 of the lower component 2. This pivotal movement of the snapper 5 is carried out contrary to the force of the spring 12. When the snapper 5 has been released from the lower component 2, the lever 3 carries out a pivotal movement to the position shown in FIG. 4, said pivotal movement being carried out due to the effect produced by the double helical spring 6. Said position shown in FIG. 4 represents the open position of the lever 3.

For the purpose of closing, a force in accordance with arrow "B" is applied to the lever 3 approximately in the central portion thereof. In response to this, the counterhook 15 of the lever 3 is lowered until it reaches the member 16. In response to further application of pressure, also the lower part of the lever 3 is lowered until it reaches the member 18. In the course of this movement, the upper component 1 is drawn towards the lower component 2, which has the effect that the counterhook 15 engages behind the locking projection 21. Shortly before the closed position of the lever 3 is reached, the inclined section 17 of the locking projection 13 of the snapper 5 comes into contact with the locking member 14, is pivoted contrary to the tension of the spring 12 of the snapper and engages then behind the locking member 14 so that the lever 3 is arrested in its closed position.

Locking of the lever 3 is effected by means of a key which is inserted into the slot of the catch means 7 provided for this purpose. When the key is turned, the bolt, 25 is brought into engagement with the angular member 8 of the lower component 2 so that the connection device is locked. For the purpose of opening, the operations are carried out in reverse order.

The connection device according to the second embodiment shown in FIGS. 6 to 10 consists of the upper component 101, which is provided with a hook 102, and of the lower component 103. The lower component 103 has pivotably provided thereon the lever 104, which, also in the case of the second embodiment shown, is designed as a one-armed lever. The lever 104 is equipped with a counterhook 105 associated with the hook 102 of the upper component.

The lever 104 is pivotably supported on the lower component 103 by means of the two U-shaped metal wire bows 106. For this purpose, the end face of the lower component 103 facing the upper component 101 has formed thereon a substantially cylindrical support means 107. Moreover, two spaced little bearing blocks 108 are provided on the end of the lever 104 facing away from the upper component 101. The snapper 109 is inserted between the two little bearing blocks 108 of the lever 104. The snapper 109 is provided at each of its ends with a support eye 110, said support eyes 110 being engaged by the legs on one side of the U-shaped metal wire bows 106 so that the pivotal support of the lever 104 is also effective for the snapper 109, said snapper being, however, adapted to be pivoted independently of the lever 104.

The support eyes 110 of the snapper 109 have inserted between them the actuating lever 111, said actuating lever having provided thereon a substantially cylindrical support member 112. The legs on one side of the metal wire bows 106 also extend through the support member 112 so that said legs define the common support axle. The actuating lever 111, too, is adapted to be pivoted independently of the lever 104 and, to a certain extent, also independently of the snapper 109, as will be explained hereinbelow.

The snapper 109 is provided with a locking projection 113 which is associated with a complementary, projecting locking member 114 of the lower component 103. The locking member 114 is formed by an angled portion on a front edge of the lower component 103. The snapper 109 is acted upon by a spring 115 whose force is directed such that said spring holds the snapper 109 in its locking position.

The legs of one of the U-shaped metal wire bows 106 have attached thereto a double helical spring 116, said spring being attached by means of its looplike helical spring members. One end 117 of the double helical spring 116 rests on the lower component 103, whereas the other end 118 rests on the lever 104. The double helical spring 116 causes the lever 104 to move to a predetermined open position, e.g. to a horizontal position, like that shown in FIG. 3. The lever 104 is maintained in said position by stop means 119, 120 provided on the lower component 103 and on the lever 104, respectively.

The U-shaped metal wire bows 106 are held on the lower component 103 by means of flaps 121 extending at an angle of 90° relative to said lower component.

The actuating lever 111 is provided with a plurality of cams 122, each of said cams having associated therewith a locking disc 123, in the case of the embodiment shown there. Each of said locking discs 123 includes in the peripheral surface thereof a recess 124 whose shape is adapted to that of the cams 122. Each of the locking discs 123 is connected to an adjustment disc 125 by means of a non-positive connection and forms together therewith a unit. The adjustment discs 125 are provided with numbers on the front side thereof and are used for the purpose of setting an opening code. The individual units consisting of the locking and adjustment discs 123, 125 are rotatably supported on pins 126 provided on the inner side of the lever 104.

The lever 104 has provided therein viewing windows 127 which display numbers or the like provided on the adjustment discs 125.

The locking discs 123 and the associated adjustment discs 125 are non-positively coupled by means of a spring 128. The locking discs 123 are provided with recessed detent portions 129, the detent cams 130 of the associated adjustment discs 125 engaging said recessed detent portions.

On the inner side of the lever 104, detent knobs 131 are provided, said detent knobs having associated therewith detent depressions 132 of the adjustment discs 125.

The actuating lever 111 is provided with a projection 133 which has associated therewith a shoulder 134 of the snapper 109. The locking projection 113 of the snapper 109 has provided thereon an inclined conducting surface 135 cooperating with the edge of the locking member 114 of the lower component 103. The snapper 109 is outwardly covered by a projecting wall 136 of the actuating lever 111 so that unauthorized manipulation of said snapper is prevented.

The lever 104 is provided with approximately triangular side pieces 137 in the area in which it is pivotably supported, said side pieces covering the snapper 109 as well as the actuating lever 111 so that these components are not accessible from the outside.

On the inner side of the lever 104 a carrier means 138 is secured in position. This carrier means is provided with bent edge portions 139 having formed therein support eyes 140, the legs on one side of the U-shaped metal wire bows 106, which define the pivot axis for the lever 104, the snapper 109 as well as the actuating lever 111, extending also through said support eyes 140. The carrier member 138 is provided with laterally projecting shoulders 141 which are inserted into upwardly open grooves 142 provided in the side pieces 137 of the lever 104.

The mode of operation of the device according to the invention is as follows:

For the purpose of opening the lever 104, the adjustment discs 125 are first of all rotated until the predetermined opening code appears in the viewing windows 127 of the lever 104. When the adjustment discs 125 are being rotated, they entrain the locking discs 123 via their detent cams 130 engaging the recessed detent portions of said locking discs, since the compression springs 128 connect said adjustment discs and said locking discs by means of a non-positive connection. The compression springs 128 are in engagement with the carrier member 138 on the one hand and with recesses of the locking discs 123 on the other. When the predetermined opening code has been set, the recesses 124 provided in the locking discs 123 are directed perpendicularly downwards. In this position of the locking discs, it is possible to pivot the actuating lever 111 upwards by taking hold of its handle 143—this pivotal movement being effected contrary to the action of the coil spring 115—since the cams 122 of the actuating lever 111 can enter the recesses 124 in this position. When the actuating lever 111 carries out this pivotal movement, said lever entrains via its projection 133 the shoulder 134 of the snapper 109 so that the locking projection 113 of the snapper 109 releases the locking member 114 of the lower component 103, which has the effect that the lever 104 can be pivoted from the closed position shown in FIG. 7 to the open position shown in FIG. 8.

If the predetermined opening code is not set such that it appears in the viewing windows 127 of the lever 104, the cams 122 of the actuating lever are positioned in front of the peripheral surfaces of the locking discs 123 so that the pivotal movement of the actuating lever 111 is blocked. The lever 104 of the connection device cannot be opened in this case.

When the lever 104 has been opened, it is advisable to disarrange the set opening code immediately so that said opening code is concealed from unauthorized persons' sight. The lever 104 can also be closed when the opening code has been disarranged, this being due to the fact that, when the lever 104 is being closed, the inclined conducting surface 135 of the locking projection 113 of the snapper 109 comes into contact with the front edge of the locking member 114 of the lower component 103 so that the snapper 109 is pivoted to the open position contrary to the action of its spring 115 and, when the closing movement of the lever 104 is continued, the locking projection 113 snaps in position behind the locking member 114.

For the purpose of varying the opening code, it is first of all necessary to adjust the previous opening code via the adjustment discs 125. The actuating lever 111 is now raised. Due to the fact that the cams 122 of the actuating lever 111 engage the recesses 124 of the locking discs 123, said locking discs are blocked and cannot rotate. If, in this position, the adjustment discs 125 are rotated, the non-positive connection between the locking discs 123 and the adjustment discs 125 is eliminated so that the code which is now set represents the new opening code.

We claim:

1. In a connection device for releasably interconnecting two separable members, comprising hook means adapted to be connected to one of the members, a lower component adapted to be connected to the other member, an elongated lever pivotably connected to the lower component, counterhook means connected at one end of the lever and operative for engaging the hook means when the connection device is in a closed position to hold the two members together and operative for disengaging from the hook means when the connection device is in an open position to allow the two members to separate, pivotable means for pivotably connecting the other end of the lever to the lower component and to allow the other end of the lever to move outward away from the lower component when the connection device is moved out of the closed position into the open position and to allow movement of the lever disengaging the hook means and the counterhook means to achieve the open position, snapper means pivotably connected to the other end of the lever, a locking projection extending from the snapper means, a projecting locking member connected to the lower component, the locking projection and the locking member operatively engaging one another to prevent the other end of the lever from moving outward away from the lower component when the locking projection is pivoted into a first position and the connection device is in the closed position, the locking projection and the locking member also operatively disengaging from one another when the locking projection is pivoted to a second position to allow the other end of the lever to move outward from the lower component and the connection device to be moved to the opened position, means for biasing the locking projection toward the first pivotable position, actuator means pivotably connected to the other end of the lever for operatively contacting and pivoting the snapper means to pivot the locking projection to the second pivotable position upon pivoting said actuator means as a result of manual force, and an improvement in combination therewith, comprising:

means pivotably connecting said snapper means and said actuator means and operative for allowing said locking projection to pivot into the second pivotable position from the first pivotable position independent of pivoting of the actuator means by manual force, the independent pivoting of the locking projection occurring upon moving the lever adjacent to the lower component to place the connection device in the closed position, the biasing means returning the locking projection to the first pivotable position after such independent pivoting movement.

2. An invention as defined in claim 1 wherein:

the pivotable means includes a member having a leg extending transversely across the other end of the lever and defining an axis about which the lever pivots at the other end, the snapper means and the actuator means are pivotably retained to the other end of the lever by the leg, and the snapper means and the actuator means are pivotable about a common support axis which is coaxial with the pivot axis defined by the leg.

3. An invention as defined in claim 2 wherein:

the actuator means further comprises a projecting wall extending in an exteriorly spaced location from the locking projection to shield the locking projection from unauthorized manipulation.

4. An invention as defined in claim 1 further comprising a combination locking means connected to the lever and operative for preventing pivoting of the actuator means except when the combination locking means is set to a predetermined code, said combination locking means comprising:

at least one pin extending toward the lower component from the inner side of the lever at a location adjacent to the other end of the lever, a locking disk rotatably connected to the pin, means defining a recess in the locking disk, a cam extending from the actuator means and operative to move into the recess when the locking disk occupies a predetermined rotational position related to the predetermined code and when the actuator means is pivoted by manual force, and the cam contacting the locking disk at a position other than the recess to inhibit sufficient pivoting of the actuator means to disengage the locking projection and the projecting locking member when the rotational position of the locking disk is other than the predetermine rotational position.

5. An invention as defined in claim 4 wherein the combination locking means further comprises:

an adjustment disk rotatably connected to the pin on the inner side of the lever and selectively connectable to the locking disk to rotate the locking disk into and out of the predetermined rotational position, code indicia formed on the adjustment disk, and means defining a window in the lever to reveal at least one code indicia on the adjustment disk upon rotation of the adjustment disk to position the code indicia indicative of the predetermined code in the window and to position the locking disk into the predetermined rotational position.

6. An invention as defined in claim 5 wherein the locking disk has an outside peripheral surface, and the recess is formed in the outside peripheral surface, and the cam is adapted to pivot into the recess upon pivoting movement of the actuator means.

* * * * *